US005172653A

United States Patent [19]

Vadakin

[11] Patent Number: 5,172,653

[45] Date of Patent: Dec. 22, 1992

[54] ADJUSTABLE ANGLE ROTARY CLEANING DEVICE

[75] Inventor: Thomas C. Vadakin, Marietta, Ohio

[73] Assignee: Vadakin, Inc., Marietta, Ohio

[21] Appl. No.: 833,533

[22] Filed: Feb. 10, 1992

[51] Int. Cl.[5] ..... F22B 37/52

[52] U.S. Cl. ..... 122/392; 15/316.1; 134/166 C; 134/167 C; 165/95

[58] Field of Search ..... 122/379, 391, 392, 382; 165/95; 134/167 C, 168 C, 166; 15/316.1, 317, 318

[56] References Cited

U.S. PATENT DOCUMENTS 1,928,880 10/1933 Cooling et al. ..... 122/392
1,978,555 10/1934 Snow ..... 122/392 X
4,572,284 2/1986 Kätscher et al. .
4,690,159 9/1987 Vadakin et al. .
4,907,542 3/1990 Maeyama et al. ..... 122/379
4,945,862 8/1990 Vadakin .
5,069,172 12/1991 Shirey et al. ..... 122/382

*Primary Examiner*—Edward G. Favors
*Attorney, Agent, or Firm*—Laubscher & Laubscher

[57] ABSTRACT

An angularly adjustable rotary cleaning device for an array of boiler tubes includes a base which is laterally displaced along a row of the tubes and a rotary cleaning mechanism connected with the base for angular adjustment with respect thereto. The rotary cleaning mechanism includes a rotating nozzle for delivering a high pressure fluid stream against and between the exterior surfaces of the spaced tubes of the array. The cleaning mechanism can be adjusted to direct the fluid stream for deepest penetration into the tube array to remove slag deposits from previously inaccessible locations within the array.

9 Claims, 2 Drawing Sheets

ADJUSTABLE ANGLE ROTARY CLEANING DEVICE

BACKGROUND OF THE INVENTION

Large solid fossil fuel fired boilers are used to generate electricity. These boilers comprise many stages including an economizer, a reheater superheater, and primary and secondary superheater stages. Within each stage are arranged a plurality of parallel boiler tubes which are arranged in spaced rows defining an array. The tubes within each row are also spaced. Often, the tubes of one row are offset relative to those of an adjacent row.

During fuel burning, byproducts are generated which become attached to the exterior surfaces of the tubes, greatly reducing the efficiency of the boiler. These byproducts include slag and ash. The present invention relates to a device for effectively cleaning these deposits from the exterior surfaces of the boiler tubes, particularly the heretofore inaccessible tubes buried within the offset tube banks.

BRIEF DESCRIPTION OF THE PRIOR ART

Rotary cleaning devices are well-known in the patented prior art, as evidenced by the Vadakin U.S. Pat. Nos. 4,690,159 and 4,945,862 which are owned by the owner of the present invention. The '159 patent discloses a swivel mechanism which rotates about and travels along a shaft. A pair of lances are connected with the swivel and serve to direct a high pressure flow of water against the interior surface of a cylindrical housing for cleaning the same. The '862 patent discloses a boiler tube cleaning assembly including a tubular lance and a rotary union connecting the lance with a bracket and rotating the lance about its axis. Pressurized cleaning fluid is supplied to the lance which directs the fluid against the tube surfaces to remove slag therefrom.

While the prior devices normally operate satisfactorily, they suffer from their inherent inaccessibility to remote boiler tubes within an array of tubes, particularly where the tubes are offset with respect to one another.

SUMMARY OF THE INVENTION

Accordingly, it is a primary object of the present invention to provide a rotary cleaning device for the tubes of a boiler including a base supported on a first row of tubes for lateral displacement along the row and a cleaning device angularly adjustably connected with the base. The cleaning device includes nozzles for directing a high pressure fluid stream against the tubes and a rotary device for rotating the nozzles with respect to the base. With the cleaning device set at the appropriate angle, the stream of high pressure fluid is directed between the offset rows of tubes. As the base is displaced along the support row of tubes, the fluid stream removes slag and other deposits from between the tubes and from the exterior surfaces of the tubes.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
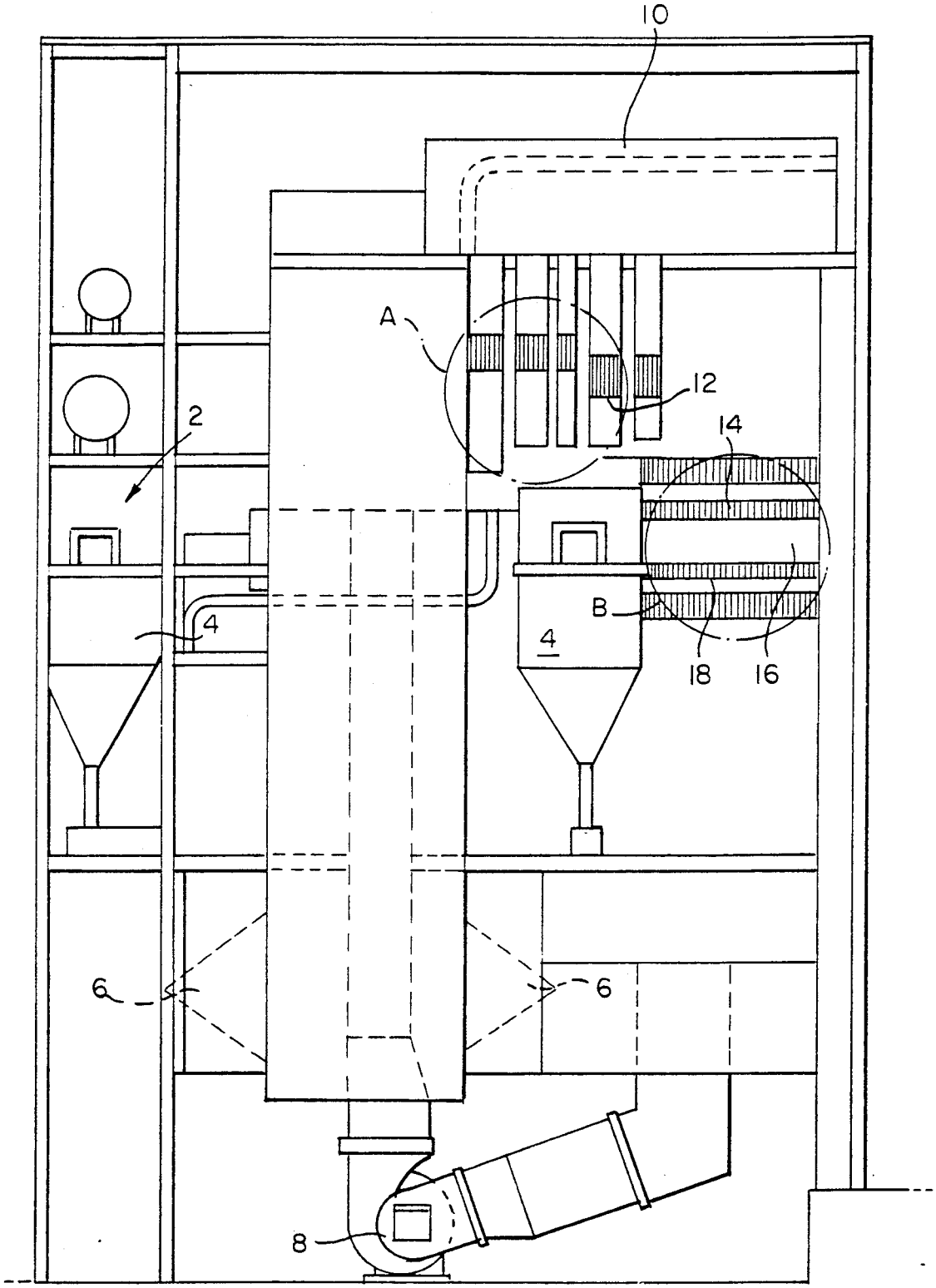
FIG. 1 PRIOR ART
FIG. 1 is a partial schematic view of an electricity generator including a solid fossil fueled boiler.

By way of background, there is shown in FIG. 1 solid fossil fired electricity generating station 2 including fuel bunkers 4 and cyclone furnaces 6. Air for the combustion process is supplied via a forced draft fan 8. During the combustion process, exhaust is passed through boiler stages including a secondary superheater 20 and a reheat superheater 12 of area A, and a primary superheater 14, a further reheat superheater 16, and an economizer 18 of area B. It is within the areas A and B that the present invention is used. The apparatus of the invention has application in bituminous, sub-bituminous, and lignite fire boilers.

Figure 2:
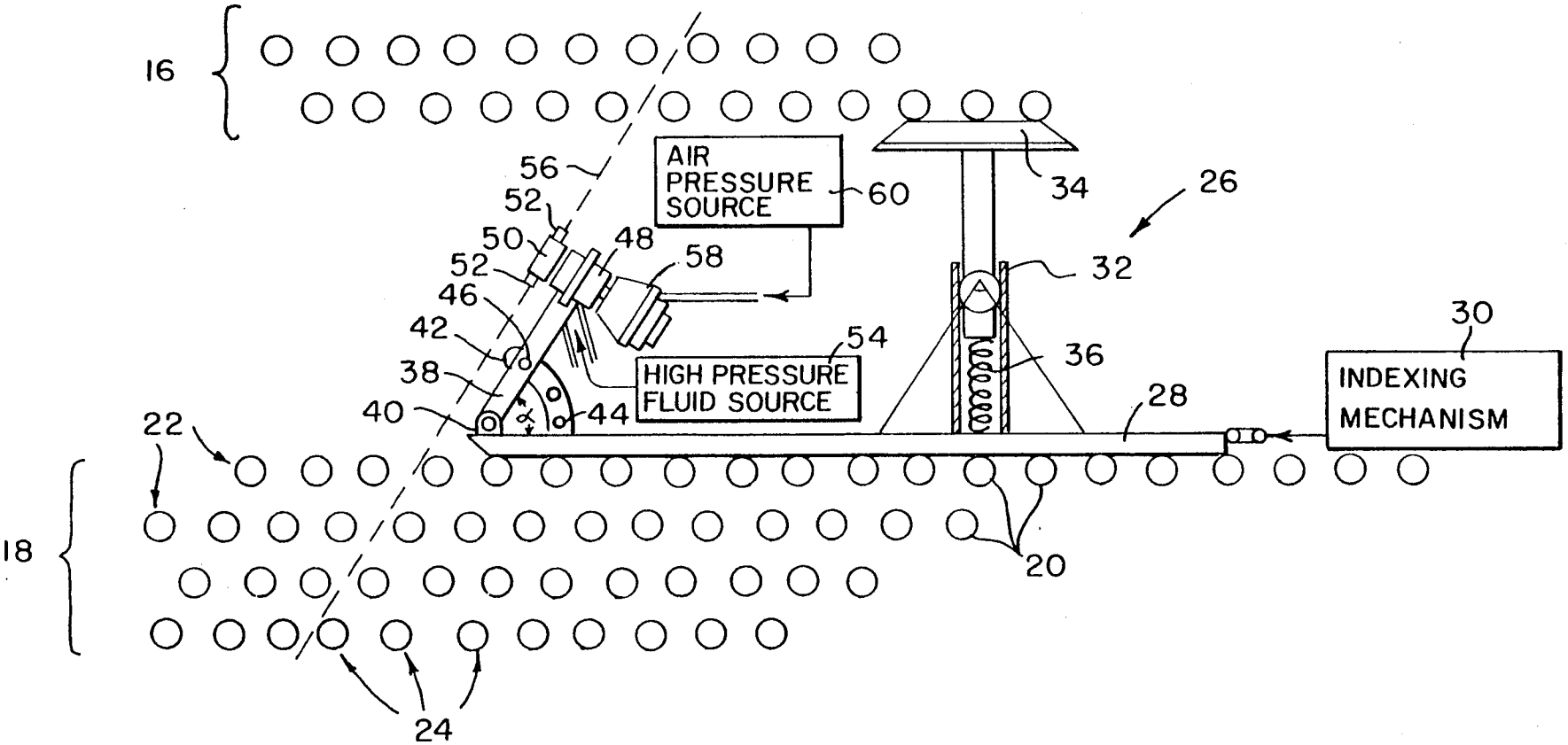
FIG. 2 is a schematic view of the angularly adjustable rotary cleaning device according to the invention.

The superheaters and economizer comprise a plurality of cylindrical tubes 20 arranged parallel to each other in spaced rows 22 with the tubes of each row being spaced and offset from the tubes of the adjacent rows as shown in FIG. 2. Thus, the tubes in alternating rows are arranged in columns 24 extending perpendicularly to the tube rows as shown in FIG. 2. A space or gap is provided between the tube arrays of the various stages of the boiler. Over time, slag and ash deposits accumulate on the tubes and ultimately fill the spaces therebetween. These deposits reduce the efficiency of the boiler.

The adjustable angle rotary cleaning device 26 for cleaning the slag deposits from the exterior surfaces of the tubes and from the spaces between the tubes will now be described with reference to FIG. 2.

The cleaning device 26 includes a base 28 in the form of a sled which is supported by a first row of tubes. The base is connected with an indexing mechanism 20 which is operable to laterally displace the entire cleaning device relative to the array of tubes. Alternatively, the base can be manually laterally displaced using a winching mechanism. In order to stabilize the base, a pedestal 32 extends upwardly therefrom and includes a runner 34 at its upper end which engages a second row of tubes of an adjacent array. The pedestal includes a spring 36 for normally biasing the runner against the second row of tubes.

At the remote end of the base 28 is provided a bracket 38 connected with the base via a pivot connection 40. Also connected between the base 28 and the bracket 38 is an adjustable angle iron 42 which is operable to lock the bracket at an angle $\alpha$ with respect to the base. For example, the angle iron 42 contains a slot or a plurality of holes 44 and the bracket contains a corresponding hole. A locking pin 46 is passed through the bracket hole and one of the angle iron holes 44 to lock the bracket in a selected angular position. It will be appreciated by those of ordinary skill in the art that any suitable locking mechanism may be provided.

At the end of the bracket 38 is connected a rotary union 48. Extending from the rotary union is a nozzle head 50 including a plurality of nozzles 52. A high pressure fluid source 54 is connected with the rotary union 48 for supplying pressurized cleaning fluid, preferably water, to the nozzle head. According to one embodiment, the nozzles 52 extend tangentially from the nozzle head 50. As the high pressure fluid exits the nozzles, the force of the fluid causes the nozzle head to rotate about the axis of the rotary union, thereby providing a high pressure fluid stream 56 extending through 360°.

By adjusting the angle of the bracket 38 relative to the base 28, the high pressure fluid stream (which extends through a plane generally parallel to the plane containing the bracket as shown in FIG. 2) can be directed to penetrate deeply into the array of tubes. As the base is indexed along the support row of tubes, the high pressure fluid stream progressively impinges upon, dislodges, and removes the slag and ash deposits from the exterior surfaces of the tubes and from the spaces between the tubes.

Where controlled rotation of the nozzle head is desired, an air motor 58 is connected with the rotary union 48 to rotate the nozzle at a given speed. An air pressure source 60 is connected with the air motor 58 to control the operation thereof. Of course, any suitable drive mechanism for the rotary union my be provided.

Because of the adjustability of the cleaning mechanism, it can be used to clean variously configured arrays of tubes in the most inaccessible boiler tube environments.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. Apparatus for cleaning the exterior surfaces of a plurality of parallel boiler tubes arranged in spaced rows, the tubes of each row being spaced and offset with respect to the tubes of an adjacent row to define an array, comprising (a) a base supported by a first row of tubes for lateral displacement through the array;

(b) cleaning means connected with said base and including a rotating nozzle for directing a high pressure fluid stream against the tubes; and (c) means for adjusting the angle of said cleaning means relative to said base, whereby when said cleaning means is positioned to direct the fluid stream between the offset tubes of the array and when said base is displaced through the array of tubes, slag deposits are removed from the exterior surfaces of the tubes.

2. Apparatus as defined in claim 1, wherein said adjusting means comprises a bracket pivotally connected with one end of said base and means for locking said bracket at a selected angle relative to said base, said cleaning means being connected with said bracket.

3. Apparatus as defined in claim 2, and further comprising a high pressure fluid source connected with said cleaning means for supplying pressurized fluid to said nozzle.

4. Apparatus as defined in claim 3, wherein said nozzle comprises a plurality of orifices extending tangentially from a nozzle head, whereby as pressurized fluid exits said orifices, said head rotates, thereby to dispense the fluid stream through 360°.

5. Apparatus as defined in claim 3, and further comprising a rotary union connecting said nozzle with said bracket.

6. Apparatus as defined in claim 5, and further comprising a drive mechanism connected with said rotary union for rotating said nozzle.

7. Apparatus as defined in claim 3, wherein said fluid comprises water.

8. Apparatus as defined in claim 3, and further comprising means for displacing said base relative to said row of tubes.

9. Apparatus as defined in claim 8, wherein said base includes an adjustable pedestal extending therefrom for engagement with a second row of tubes parallel to and spaced from said first row of tubes, thereby to further support said base.

* * * * *